US006951200B2

(12) United States Patent
Sakaguchi et al.

(10) Patent No.: US 6,951,200 B2
(45) Date of Patent: Oct. 4, 2005

(54) FUEL INJECTION RATE CONTROL DEVICE

(75) Inventors: Hisayuki Sakaguchi, Osaka (JP); Yasuhiro Kanatsu, Osaka (JP)

(73) Assignee: Yanmar Co., Ltd. (JP)

( * ) Notice: Subject to any disclaimer, the term of this patent is extended or adjusted under 35 U.S.C. 154(b) by 0 days.

(21) Appl. No.: 10/758,108

(22) Filed: Jan. 16, 2004

(65) Prior Publication Data

US 2004/0163622 A1 Aug. 26, 2004

Related U.S. Application Data

(63) Continuation of application No. PCT/JP02/06876, filed on Jul. 5, 2002.

(51) Int. Cl.[7] ..... F02D 31/00
(52) U.S. Cl. ..... 123/366; 123/179.17
(58) Field of Search ..... 123/366, 367, 123/373, 374, 381

(56) References Cited

U.S. PATENT DOCUMENTS

| | | | | | |
|---|---|---|---|---|---|
| 3,577,978 | A | * | 5/1971 | Garcea | 123/339.1 |
| 3,640,259 | A | * | 2/1972 | Garcea | 123/365 |
| 3,814,072 | A | * | 6/1974 | Gillespie | 123/179.17 |
| 3,970,064 | A | * | 7/1976 | Eheim et al. | 123/373 |
| 4,112,897 | A | * | 9/1978 | Hufendiek | 123/366 |
| 4,143,634 | A | * | 3/1979 | Ritter et al. | 123/179.15 |
| 4,204,510 | A | * | 5/1980 | Ritter et al. | 123/179.16 |
| 4,239,025 | A | * | 12/1980 | Konrath et al. | 123/366 |
| 4,254,753 | A | * | 3/1981 | Ritter et al. | 123/366 |
| 4,312,312 | A | * | 1/1982 | Hofer et al. | 123/339.29 |
| 4,372,267 | A | * | 2/1983 | Adams | 123/366 |
| 4,426,971 | A | * | 1/1984 | Isoda | 123/367 |
| 4,449,499 | A | * | 5/1984 | Ito | 123/339.24 |
| 5,193,505 | A | * | 3/1993 | Straubel et al. | 123/366 |
| 5,255,652 | A | * | 10/1993 | Boehm et al. | 123/366 |
| 5,460,132 | A | * | 10/1995 | Ishiwata et al. | 123/364 |

FOREIGN PATENT DOCUMENTS

| | | |
|---|---|---|
| JP | 59-107934 | 7/1984 |
| JP | 10-196407 | 7/1998 |
| JP | 10-227234 | 8/1998 |

* cited by examiner

*Primary Examiner*—Thomas Moulis
(74) *Attorney, Agent, or Firm*—Sterne, Kessler, Goldstein & Fox P.L.L.C.

(57) ABSTRACT

In an engine (1) in which the fuel injection rate is controlled by a governor (11) having a construction in which the turning of a governor lever (31) connected to the control lever (16) of a fuel injection pump (12) is controlled within a fixed range by a control section (33*b*) installed in a limiter (32), on the side surface of the engine (1), a stopper (40) for determining the maximum fuel injection position of the limiter (32) is provided with a heat sensitive expansion member, so that the expansion of the heat sensitive expansion member with increasing temperature causes the maximum fuel injection position of the limiter (32) to move to the fuel quantity decrease side.

19 Claims, 8 Drawing Sheets

FUEL INJECTION RATE CONTROL DEVICE

TECHNICAL FIELD OF THE INVENTION

The present invention relate to a centrifugal governor of an engine, which increases fuel supply rate when the engine is cold, and automatically decreases it when the engine gets warm.

BACKGROUND ART

Conventionally, there is a well-known centrifugal governor provided in a diesel engine, wherein the centrifugal governor comprises a governor shaft driven by a crankshaft through gears and the like, and a governor weight disposed around the governor shaft and connected to a governor lever through a sleeve. The governor lever is connected to a control rack of a fuel injection pump.

In this construction, when the engine is started and engine speed is increased, the governor weight is opened by centrifugal force and the sleeve is slid. Accordingly, the governor lever is turned and the control rack is slid in its fuel decreasing direction, thereby decreasing the injection rate of the fuel injection pump. On the contrary, when the engine speed is decreased and the centrifugal force applied on the governor weight is decreased, the governor weight is closed by a spring biasing the governor weight to the opposite direction, thereby sliding the control rack of the fuel injection pump in its fuel increasing direction.

The governor also has a limiter for controlling the turning of the governor lever so as to prevent the fuel injection rate from being over or under the set value. The fuel injection rate is maximum at the start of driving an engine, and after the engine speed arises to some degree, the fuel injection rate is decreased. When a certain engine speed is reached, reduction of the fuel injection rate is stopped. Afterward, the injection rate is kept constant until engine speed reaches the maximum. For example, the Japanese Patent Laid Open Gazette Hei. 10-227234 discloses a limiter lever for controlling the turning of the governor lever within a fixed range, wherein a stopper bolt is provided to demarcating the maximum turning degree of the limiter lever. When the output of the engine is set to its upper limit by a regulator handle, the stopper bolt abuts against the limiter lever so as to demarcate the position of the limiter lever. In this way, the limiter lever is located so as to control the turning range of the governor lever between the injection rate increasing direction and the injection rate decreasing direction.

The position of the above limiter should be determined so as to get the best fuel injection rate in consideration of combustion efficiency and restriction of exhaust emission. However, the best fuel injection rate changes depending on the temperature of an engine. When engine speed is increased in a warm condition, combustion efficiency of the engine is high so that low fuel injection rate is desired so as to reduce exhaust emission. However, when increasing engine speed with fuel injection of this low rate in a cold condition, combustion efficiency of the engine is reduced so that a long time is required to increase the engine speed to its rated value.

Therefore, the position of the limiter is desired to be adjustable corresponding to the temperature of the engine. However, in the above-mentioned disclosed art, it is unreasonable to adjust the position of the stopper bolt corresponding to variation of engine temperature. Therefore, in fact, the time for starting up an engine, i.e., for increasing the rotational speed of a started engine is changed with temperatures.

SUMMARY OF THE INVENTION

An object of the present invention is to provide a centrifugal governor provided with a mechanism having a limiter for controlling a governor lever connected to a fuel injection control portion of a fuel injection pump within a fixed range so as to control the amount of supplied fuel, wherein, especially when an engine whose output power is set to its maximum is started up to increase engine speed to a target value, the fuel injection rate is increased to start up the engine smoothly if the engine is cold, and is automatically decreased to improve fuel consumption efficiency and reduce exhaust emission if the engine is warm.

To achieve the object, according to the present invention, the position of the limiter is changed corresponding to temperature. A heat sensitive expansion member serving as means for changing the position of the limiter is installed in a stopper for demarcating a position of the limiter when the engine output is set to the maximum. The stopper changes the position of the limiter, that is, the position for limiting rotation of the governor lever, corresponding to dilatation of the heat sensitive expansion member. Namely, the turning limit position of the governor lever is automatically changed according to variation of temperature of the engine so as to control the threshold fuel injection rate.

The governor lever is connected to a control lever which is rotatable integrally with a plunger of the fuel injection pump. The limiter is provided with a controlling section for determining a position for limiting at least the fuel decreasing turning of the governor lever so as to control its turning within a fixed range. By adjusting the position of the limiter according to variation of temperature, the stopper changes the position of the controlling section. Namely, change of the position of the controlling section according to variation of temperature changes the limit position of the governor lever turning in fuel decreasing direction with increasing engine speed.

Therefore, in the process of increasing the rotational speed of the started engine, when the engine speed is extremely low at the beginning, the maximum fuel injection rate is secured so as to start the engine smoothly. As the engine speed is increased, the fuel injection rate is reduced. When the engine speed reaches a certain value, the fuel reduction is stopped by the above-mentioned controlling section. Afterward, the fuel injection rate is kept substantially constant while the engine is further increased to the maximum. The constant fuel injection rate kept after the fuel reduction is changed by changing the position of the controlling section according to variation of the temperature. Namely, when the engine temperature is high, a low fuel injection rate is established so as to obtain effects such as reduction of exhaust emission, prevention of black smoke, and fuel consumption saving. When the engine temperature is low, a high fuel injection rate is automatically established so as to improve combustion efficiency and to rapidly increase the engine speed to a target value. In this way, whether the engine is cold or hot, the time required for starting up the engine to get the predetermined engine speed for enabling works using the engine is substantially uniformed.

The stopper having the heat sensitive expansion member further includes slide members slid according to expansion of the heat sensitive expansion member, and a slide restriction member for restricting slide of the slide members. The heat sensitive expansion member, the slide members and the slide restriction member are disposed in a casing so as to constitute the stopper, which is simple and economic and has high durability.

Bimetal, shape memory alloy, wax, etc. can be considered as the heat sensitive expansion member. Compared with bimetal and a shape memory alloy, inexpensive wax is more available, and can also make a setup of temperature more easily. Moreover, the heat sensitive expansion member using wax can be compact.

A spring may serve as the slide restriction member. A spring is cheap and reliable. A spring is easily exchangeable and producible corresponding to the casing and the required restriction power.

The stopper is attached to a side surface of the engine, thereby facilitating its easy attachment, detachment and positional adjustment from the outside of the engine. Moreover, the temperature of the side surface of the engine can be transferred effectively to the heat sensitive expansion member.

These, other and further objects, features and advantages of the invention will appear more fully from the following description taken in connection with the accompanying drawings.

BEST MODE FOR CARRYING OUT THE INVENTION

Figure 1:
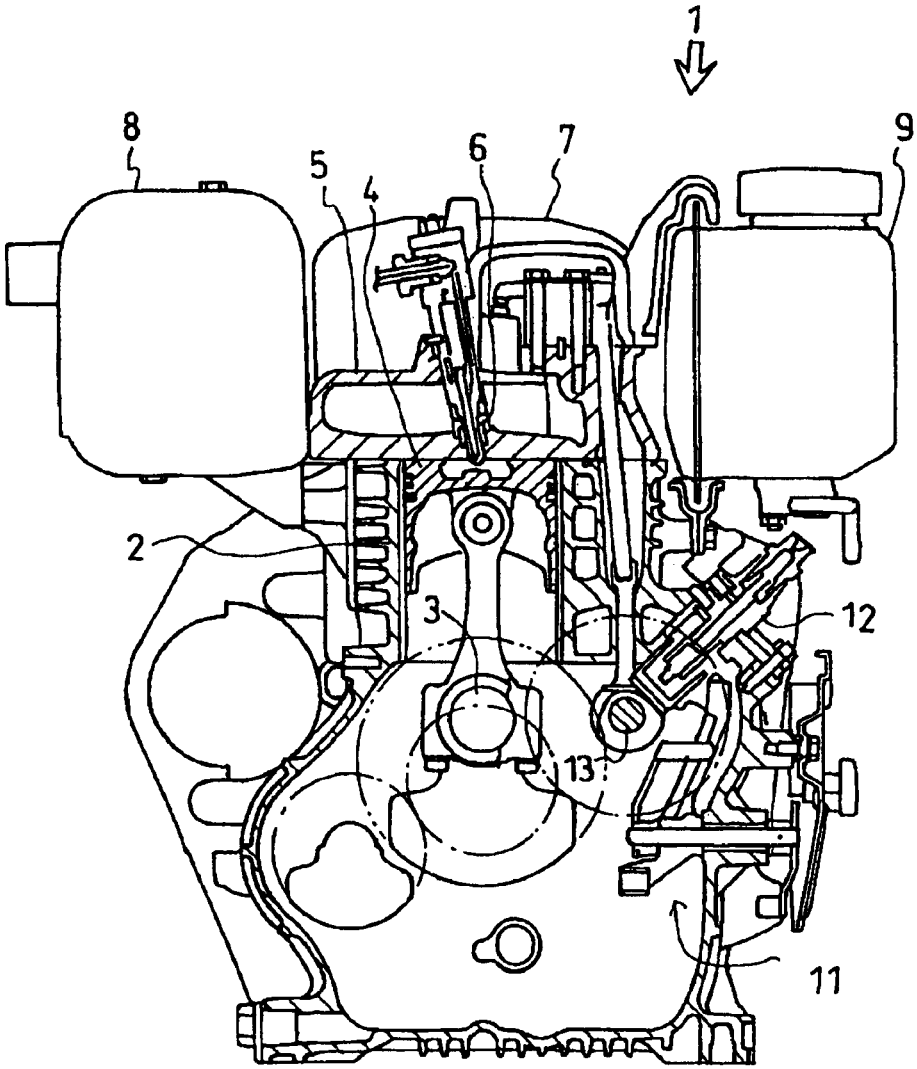
FIG. 1 is a sectional front view of an engine equipped with a fuel injection rate control device according to the present invention.

As shown in FIG. 1, in an engine 1 employing the present invention, a lower portion of a cylinder block 2 incorporating a piston 4 serves as a crankcase journaling a crankshaft 3 therein. An upper portion of the cylinder block 2 is covered with a cylinder head 5, which incorporates inlet and exhaust valves, a fuel injection nozzle 6 and the like and is covered with a bonnet 7. A muffler 8 is disposed on one side of the bonnet 7, and a fuel tank 9 is disposed on another side thereof.

Figure 4:
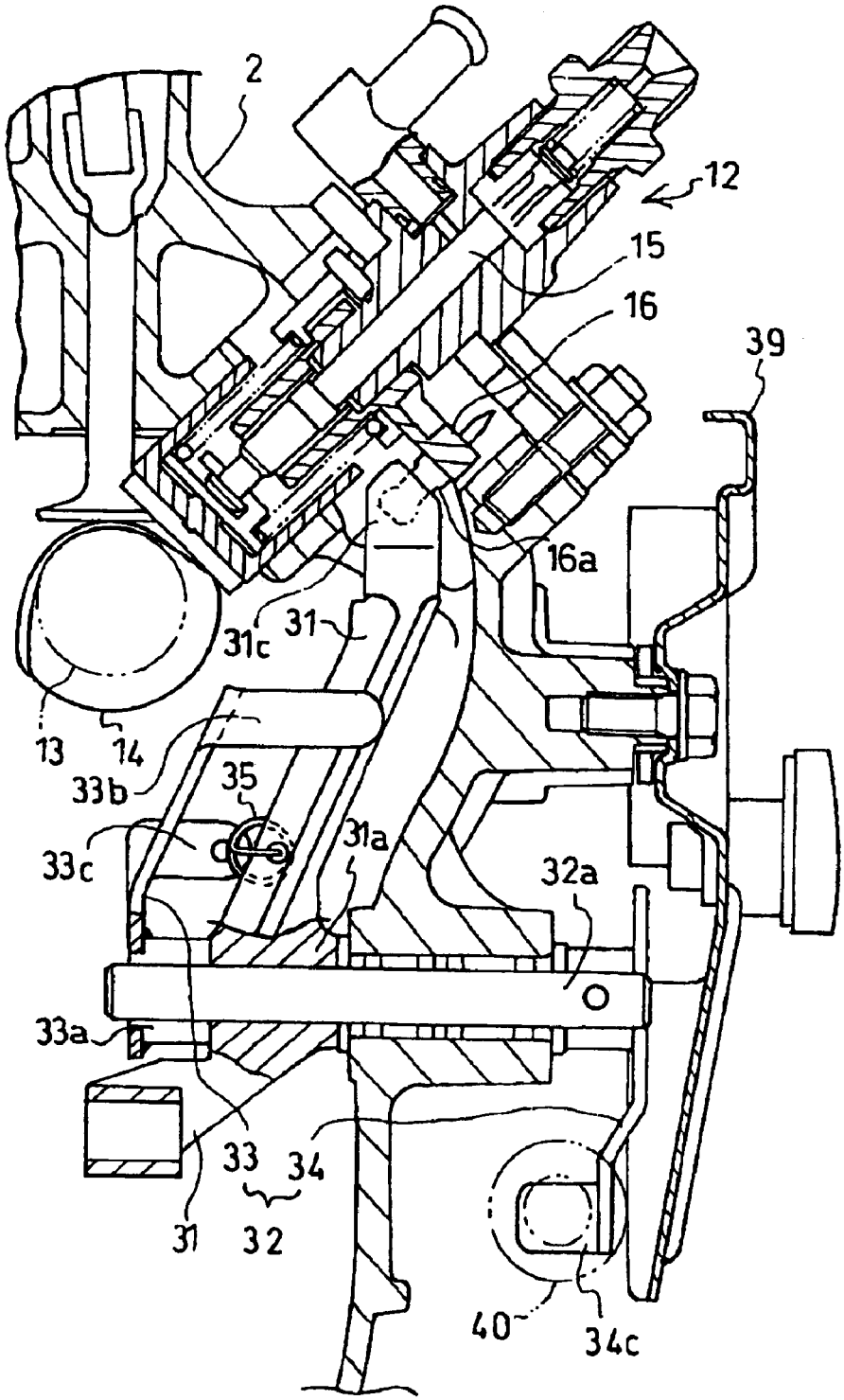
FIG. 4 is a sectional front view of the governor.

A governor 11 is arranged in the crankcase at the lower portion of the cylinder block 2, and a fuel injection pump 12 is arranged above the governor 11. As shown in FIG. 4, a plunger 15 is disposed in the fuel injection pump 12. Power is transferred to a camshaft 13 through a gear on the crankshaft 3 so that a cam 14 provided on the camshaft 13 reciprocates the plunger 15 so as to inhale fuel from the fuel tank 9, whereby fuel of a predetermined quantity is supplied to the fuel injection nozzle 6 at a predetermined timing. By rotating a control lever 16, the plunger 15 is integrally rotated so as to change its effective stroke, thereby adjusting the fuel injection rate of the fuel injection pump 12.

Figure 3:
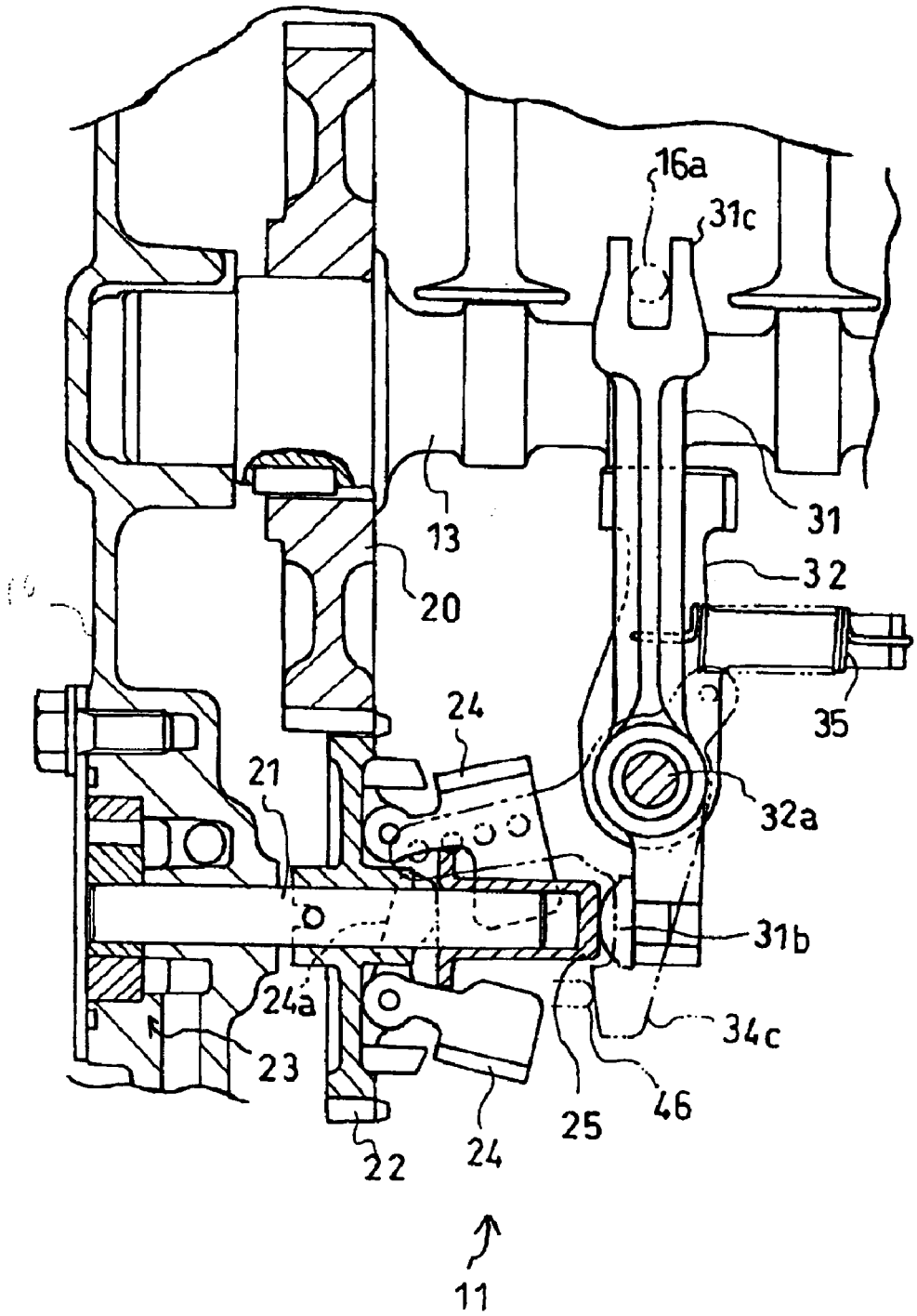
FIG. 3 is a sectional side view of a governor in the engine.

As shown in FIG. 3, power is transferred from a gear 20 fixed on the camshaft 13 to a gear 22 fixed on a governor shaft 21. A lubricating oil pump 23 is provided between one end of the governor shaft 21 and the crankcase, and the governor 11 is disposed on the other end of the governor shaft 21.

Explanation will be given of the construction of the governor 11. A governor weight 24 is pivoted at its intermediate portion on the gear 22 by a pin. One end of the governor weight 24, serving as a weight, is opened with increasing its rotational speed, and the other end thereof serves as an arm 24*a* engaging with a sleeve 25. A tip of the sleeve 25 is so arranged as to abut against a contact portion 31*b* of a governor lever 31.

Explanation will be given of the governor lever 31 and a limiter 32 in accordance with FIGS. 3 to 6. The governor lever 31 is formed at its intermediate portion with a boss 31*a* pivotally supported on a connection shaft 32*a* of the limiter 32. One (a lower) end of the governor lever 31 is convexed to serve as the contact portion 31*b* in contact with the sleeve 25, and another (upper) end thereof is forked to serve as an engaging portion 31*c* into which an engaging pin 16*a* projecting from the control lever 16 is fitted.

When the rotational speed of the crankshaft 3 in the engine 1 is increased, the torque of the crankshaft 3 is transmitted to the governor shaft 21 through gears and the like so as to cause the centrifugal force for opening the governor weight 24, thereby pushing out the sleeve 25 and turning the governor lever 31, so that the control lever 16 is turned to decrease the fuel injection rate so as to control the rotational speed to a setting speed. On the contrary, when the rotational speed of the crankshaft 3 is decreased, the governor weight 24 is closed and the control lever 16 is turned to the opposite direction so as to increase the fuel injection rate, whereby the rotational speed is increased to the setting speed.

The limiter 32 is constituted by an inner arm 33 and an outer arm 34 mutually integrally connected through the connection shaft 32*a*.

One end of the inner arm 33 is formed into a boss 33*a* fixed on the connection shaft 32*a*. The other end thereof is folded in a U-like shape when viewed in plan so as to serve as a control section 33*b*. The governor lever 31 is passed through the control section 33*b*, so that the turning of the governor lever 31 in fuel increasing direction is controlled by one side edge 33*b*R of the control section 33*b*, and the turning of the governor lever 31 in fuel decreasing direction is controlled by the other side edge 33*b*L of the control section 33*b*. Consequently, the turning of the governor lever 31 is permitted within the predetermined range. An anchoring section 33*c* projects sideward from a middle portion of the inner arm 33. By interposing a spring 35 between the anchoring section 33*c* and the governor lever 31, the governor lever 31 is biased so as to abut against the side edge 33*b*R of the control section 33*b*.

The outer arm 34 is fixed at its center portion onto the connection shaft 32*a* projecting outward from a main body of the engine 1 (cylinder block 2). Three arms 34*a*, 34*b* and 34*c* project radially from the center portion of the outer arm 34 fixed on the connection shaft 32*a*. The first arm 34*a* and the second arm 34*b* are connected to a regulator handle 39 through springs 36 and 37, and the third arm 34*c* abuts against a tip of a slide shaft 46 of a stopper 40.

The regulator handle 39, serving as mean for setting the output power of the engine and for stopping the engine 1, can be rotated along a lever guide 38 and kept in arbitrary positions. When the regulator handle 39 is set to its maximum output position, the tip of the slide shaft 46 abuts against the third arm 34*c*, whereby the control section 33*b* of the limiter 32 is set to a position for controlling the turning of the governor lever 31 for obtaining the maximum output power.

The construction of the stopper 40 will be explained in accordance with FIGS. 7(*a*) to (*c*). A cylindrical casing 41 is connected at its one end to a heat sensitive expansion section 42, in which a heat sensitive expansion member, such as wax, shape memory alloy or bimetal, is enclosed. A piston 43 projects from the heat sensitive expansion section 42 into the casing 41. Expansion of the heat sensitive expansion member in the heat sensitive expansion section 42 causes the piston 43 to further project. In this embodiment, cheap and highly available wax is used as the heat sensitive expansion member. Component of the wax is controlled so as not to expand under about 24° C.

In the casing 41 are contained a first slide shaft 44, a spacer 45, a second slide shaft 46, a seal 47, and a first spring 48 and a second spring 49 serving as members for restricting slide of the respective slide shafts 44 and 46. The first slide shaft 44 is formed with a spring seat 44*a* at its one (basal) end toward the heat sensitive expansion section 42. A slidable spacer 45 is provided on the other (tip) end of the first slide shaft 44, and a retaining ring 50 is fixed on the tip of the first slide shaft 44 so as to prevent the spacer 45 from falling out. The first spring 48 is disposed around the first slide shaft 44 between the spacer 45 and the spring seat 44*a*.

The second slide shaft 46 is formed at its one (basal) end toward the spacer 45 with a spring seat 46*a* and a recess 46*b* axially extended from the spring seat 46 so that the (tip) end of the first slide shaft 44 can be inserted into the recess 46*b*. The seal 47 is disposed in the casing 41 so as to cover a hole 41*a* opened at a tip of the casing 41. The other (tip) end of the second slide shaft 46 is diametrically small so as to penetrate the seal 47 and the hole 41*a*, and movably projects from the tip of the casing 41.

The second slide shaft 46 is formed with a step 46*c* between its diametrically small tip and its barrel portion around the recess 46*b*. As shown in FIG. 7(*b*), the step 46*c* abuts against the seal 47 so as to restrict the outward sliding movement of the second slide shaft 46 in casing 41 in accordance with expansion of he heat sensitive expansion section 42. As shown in FIG. 7(*a*), unless the heat sensitive expansion section 42 is expanded, an allowable movement distance L1 is provided between the seal 47 and the step 46*c*.

The second spring 49 is disposed around the second slide shaft 46 between the seal 47 and the spring seat 46*a*. The first and second springs 48 and 49 are so constructed that elastic force (T1) of the first spring 48 is larger than elastic force (T2) of the second spring 49 (T1>T2).

Figure 2:
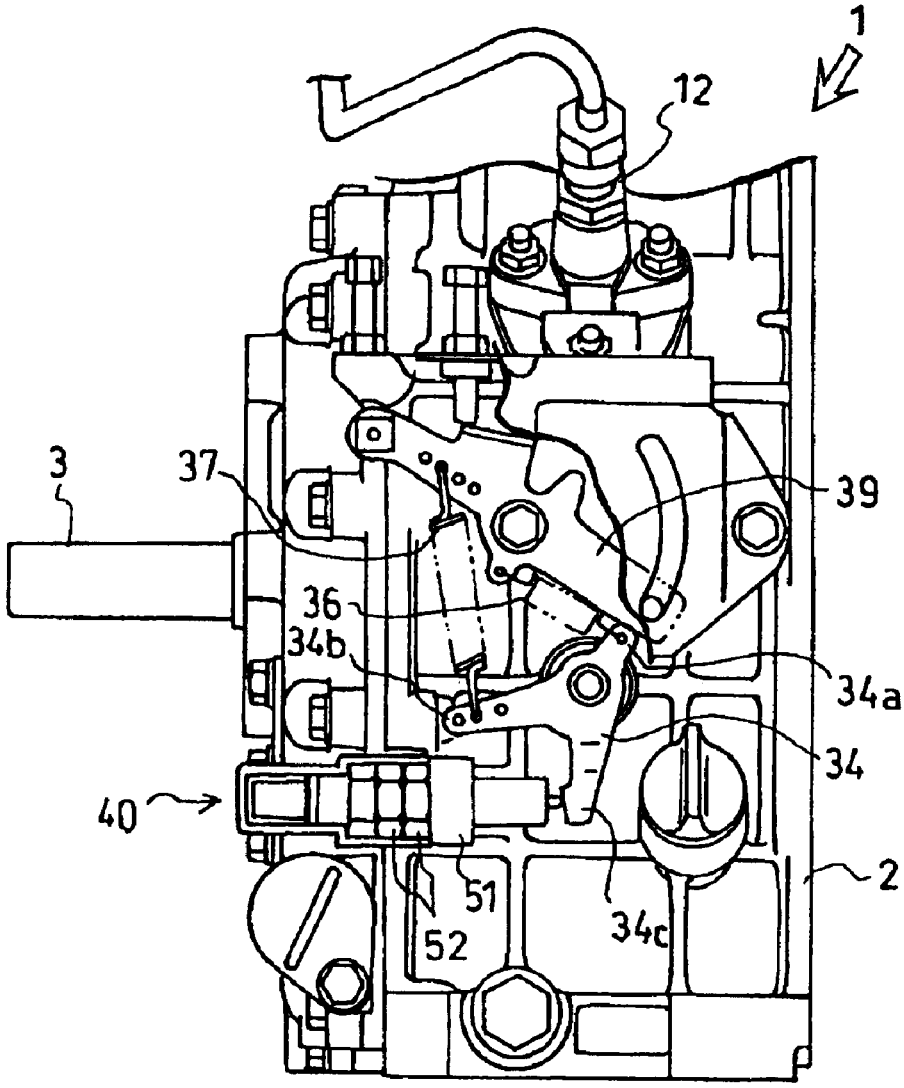
FIG. 2 is a side view of the above.
Figure 5:
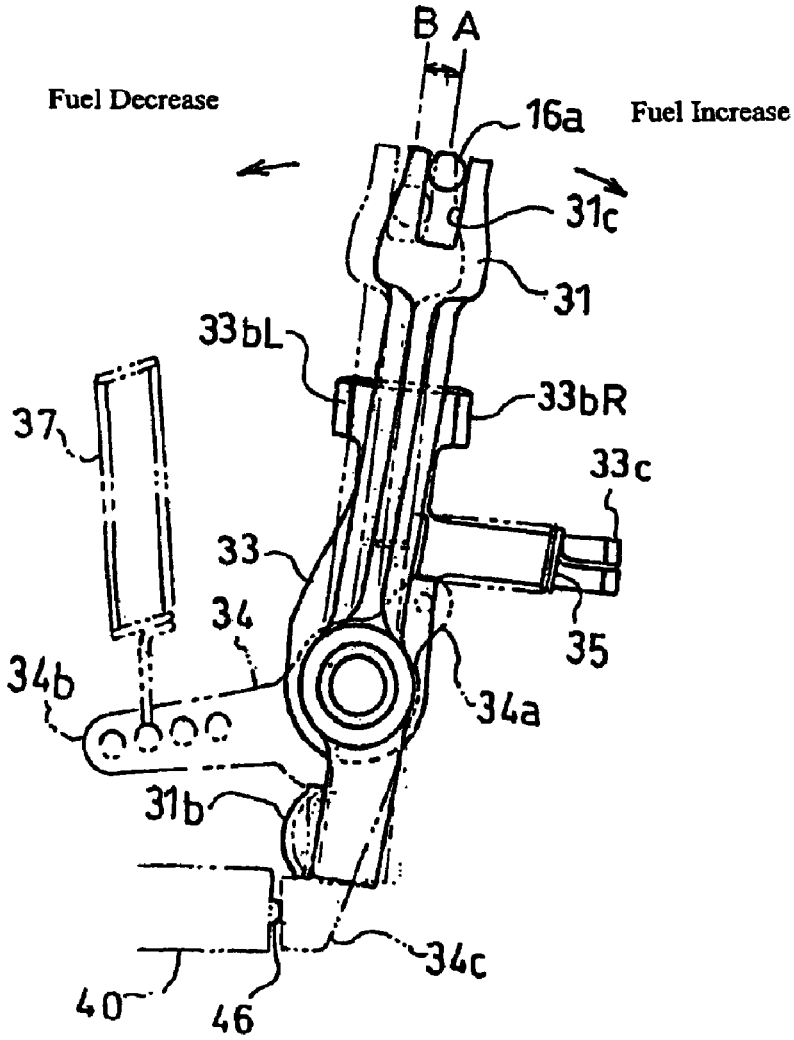
FIG. 5 is a side view of a governor lever, a limiter and a stopper when the engine is cold.
Figure 6:
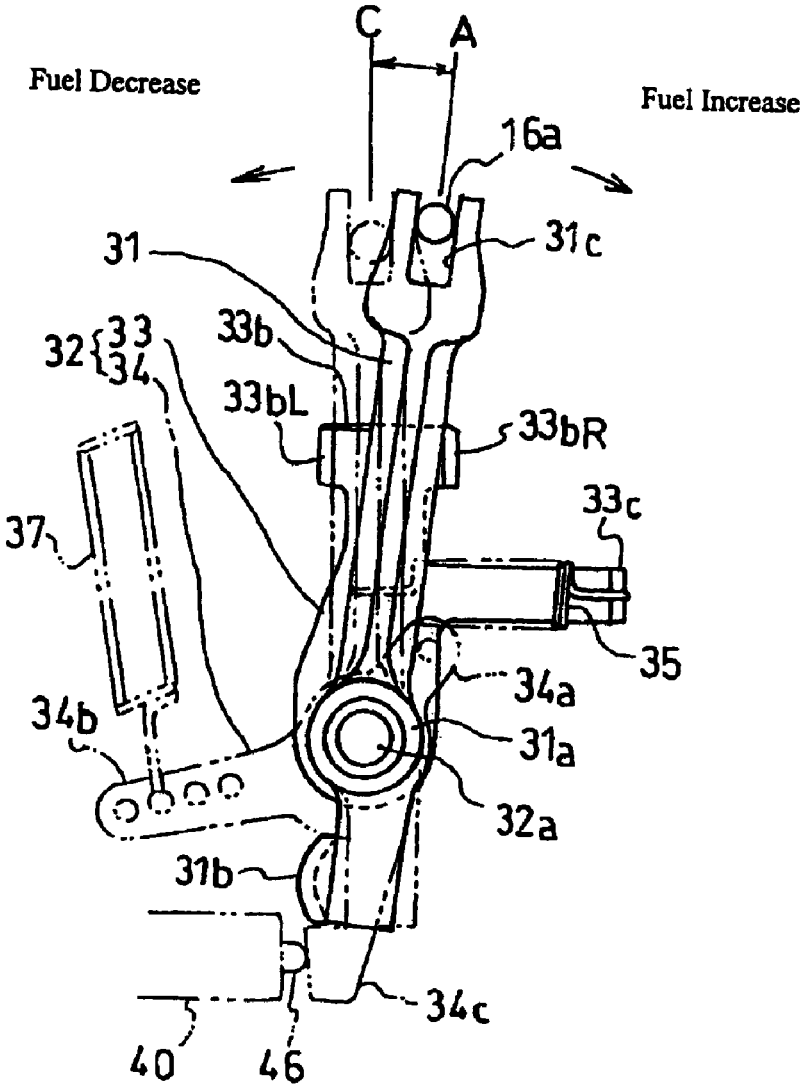
FIG. 6 is a side view of the governor lever, the limiter and the stopper when the engine is warm.

An outer peripheral portion of the casing 41 is threaded so as to serve as a screw section 41*b*. As shown in FIG. 2, the screw section 41*b* of the casing 41 is screwed into an internal thread of a mount portion 51 projecting from the side surface of the crankcase at the lower portion of the cylinder block 2 of the engine 1. The casing 41 is positioned so that the tip of the second slide shaft 46 projecting from the tip of the casing 41 abuts against the third arm 34*c* of the limiter arm 34, and then, the casing 41 is locked to the mount portion 51 by nuts 52. In this way, the stopper 40 is disposed so as to touch the side surface of the main body of the engine, whereby heat of the main body of the engine is transferred from the casing 41 to the heat sensitive expansion member in the heat sensitive expansion section 42. As shown in FIGS. 5 and 6, the tip of the second slide shaft 46 pushes the third arm 34*c* by biasing force of the spring 37. The mounting position of the stopper 40 can be changed easily by loosening the nuts 52 and rotating the casing 41 so as to adjust the state of the outer arm 34 determined by operating the stopper 40 (namely, the operating state of the limiter 32).

Explanation will be given of the position change of the limiter 32 due to change of the state of the above-mentioned stopper 40 in accordance with FIGS. 5 and 6, with explanation of the state change of the stopper 40 due to change of engine temperature as the above in accordance with FIG. 7.

The following explanation premises that the regulator handle 39 is set to its maximum output position as shown in FIG. 2. As long as the regulator handle 39 is retained in this position, the tip of the second slide shaft 46 of the stopper 40 is pressed against the third arm 34*c*. Accordingly, the limiter 32 is rotated by the forward and backward movement of the second slide shaft 46 due to change of the engine temperature, whereby the position of the control section 33*b* of the inner arm 33 is changed.

Figure 7:
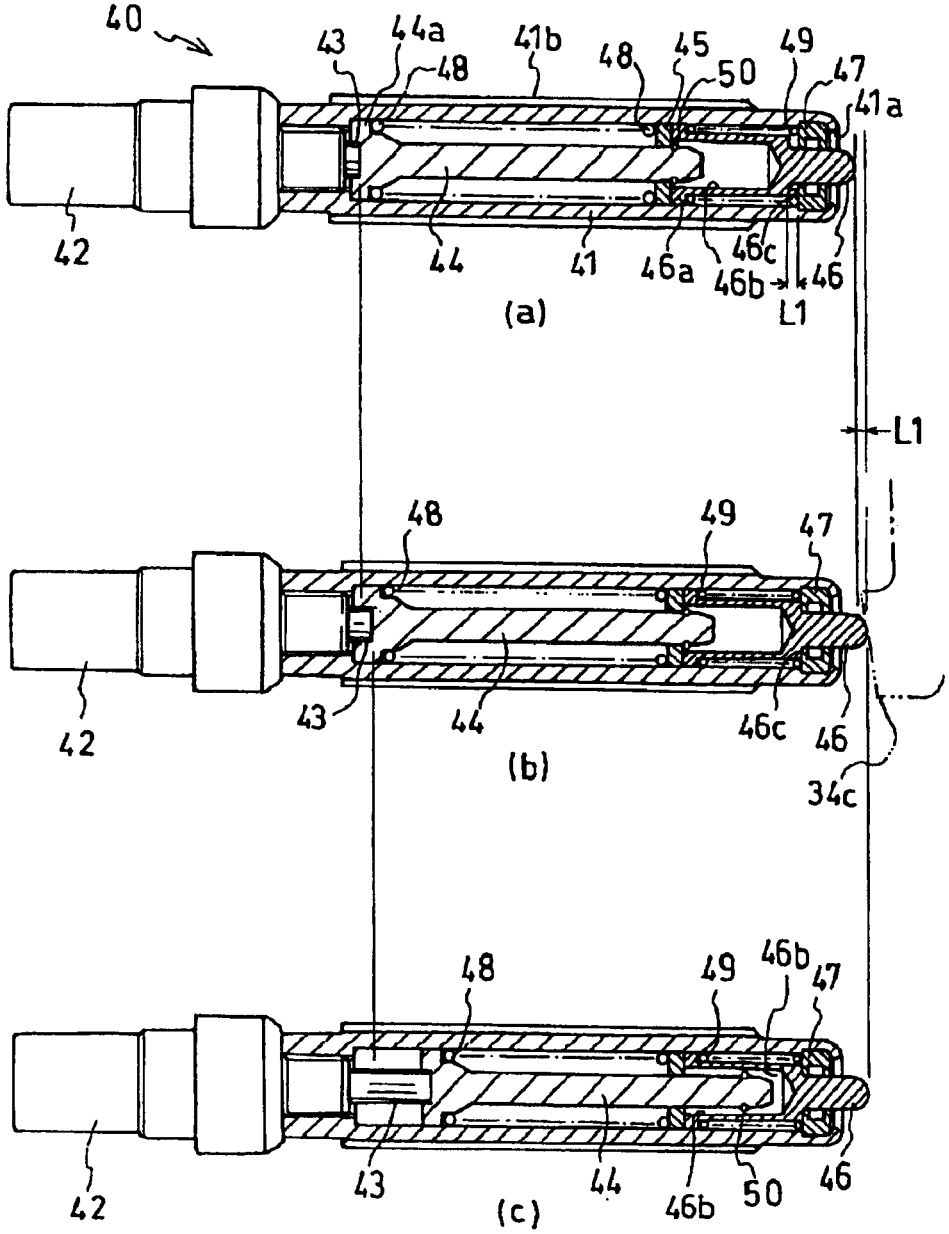
FIGS. 7(*a*), (*b*) and (*c*) are sectional views of the stopper showing its variation with changing temperature: (*a*) illustrates a state of the stopper when the engine temperature is low; (*b*) illustrates a state of the stopper when the engine temperature is high; and (*c*) illustrates a state of the stopper when the engine temperature is still higher.

Before the engine is warmed up (under 24° C.), the heat sensitive member in the heat sensitive expansion section 42 of the stopper 40 does not expand, as shown in FIG. 7(*a*), whereby the piston 43 is positioned at its shrinkage position. Therefore, as mentioned above, the allowable movement distance L1 is secured between the step 46*c* of the second slide shaft 46 and the seal 47, and the tip portion of the second slide shaft 46 projecting from the tip of the casing 41 is the shortest. At this time, the inner arm 33 of the limiter 32 is disposed in fuel increasing direction, as shown in FIG. 5.

When the engine is warmed up (over 24° C.) and the heat sensitive member in the heat sensitive expansion section 42 expands so that the piston 43 projects as shown in FIG. 7(*b*), thereby sliding the first slide shaft 44 against the biasing force of the second spring 49. Then, the step 46*c* of the second slide shaft 46 comes to abut against the seal 47 so as to stop the slide of the first slide shaft 44. Namely, the second slide shaft 46 moves the distance L1 and pushes the third arm 34*c* so as to rotate the inner arm 33 of the limiter 32 to the fuel decreasing direction, whereby the limiter 32 is disposed in a position shown in FIG. 6.

If the temperature of the engine block is still higher, the heat sensitive member in the heat sensitive expansion section 42 is further expanded so that the piston 43 is further extended to slide out the first slide shaft 44, while the second slide shaft 46 cannot slide because the step 46*c* of the second slide shaft 46 abuts against the seal 47 as shown in FIG. 7(*c*). However, by sliding out the first slide shaft 44, the first spring 48 between the slide shafts 44 and 46 is compressed, and the tip of the first slide shaft 44 is inserted into the recess 46*b* of the second slide shaft 46. In this way, when the temperature is above a certain value, only the tip of the first slide shaft 44 is inserted into the recess 46*b* while the piston 43 being extended. By the seal 47, the second slide shaft 46 is controlled so as not to project further than the fixed degree (L1), and the limiter 32 is also held at the position shown in FIG. 6.

Change of the position of the governor lever 31 and change of the fuel injection rate while starting up the engine to increase engine speed to a target value will be explained in accordance with FIGS. 4 to 6 and 8, premised on the above-mentioned position setting of the limiter 32 corresponding to the difference of engine temperature.

When starting the engine, the engine speed is close to zero so that the centrifugal force is not applied on the governor weight 24, whereby the sleeve 25 is not pushed out. At this state, the governor lever 31 abuts at its contact portion 31*b* against the tip of the sleeve 25 and engages at its other end, i.e., the engaging portion 31*c* with the control lever 16, so that the control lever 16 is located at its maximum turning position in the fuel increasing direction.

At this time, if the engine temperature of the engine is high, as shown in FIG. 6, the limiter 32 is disposed in the fuel decreasing direction so that the side edge 33*b*R of the control section 33*b* thereof abuts against the governor lever 31 at its maximum turning position A in the fuel increasing direction.

As the engine temperature is decreased, the side edge 33*b*R of the control section 33*b* also moves in the fuel increasing direction, as shown in FIG. 5. However, the governor lever 31 at its maximum turning position A in the fuel increasing direction does not move further in the fuel increasing direction. Namely, when the engine speed is very low immediately after its starting, the governor lever 31 is held at the substantially same position A regardless of engine temperature, and a fuel injection rate V1 is kept as shown in FIG. 8.

When the engine speed increasing from zero exceeds a certain value N1, the governor weight 24 is opened and the sleeve 25 is pushed put, thereby turning the governor lever 31 in the fuel decreasing direction. Accordingly, the control lever 16 is rotated in the fuel decreasing direction so that the fuel injection rate is decreased according to the increase of engine speed, as shown in FIG. 8.

The governor lever 31 moving in the fuel decreasing direction finally abuts against the side edge 33*b*L of the control section 33*b* to be prevented from further turning in the fuel decreasing direction. Even if the engine speed is further increased, the fuel injection rate is not further decreased, that is, the fuel injection rate is kept constant. As shown in FIGS. 5 and 6, the turning position of the governor lever 31 controlled by the side edge 33*b*L is changed correspondingly to the engine temperature. When the engine temperature is low, the controlled turning position of the governor lever 31 is set to a position B shown in FIG. 5. When the engine temperature is high, the controlled turning position of the governor lever 31 is set to a position C shown in FIG. 6 in further fuel decreasing direction from the controlled turning position B corresponding to low temperature.

Figure 8:
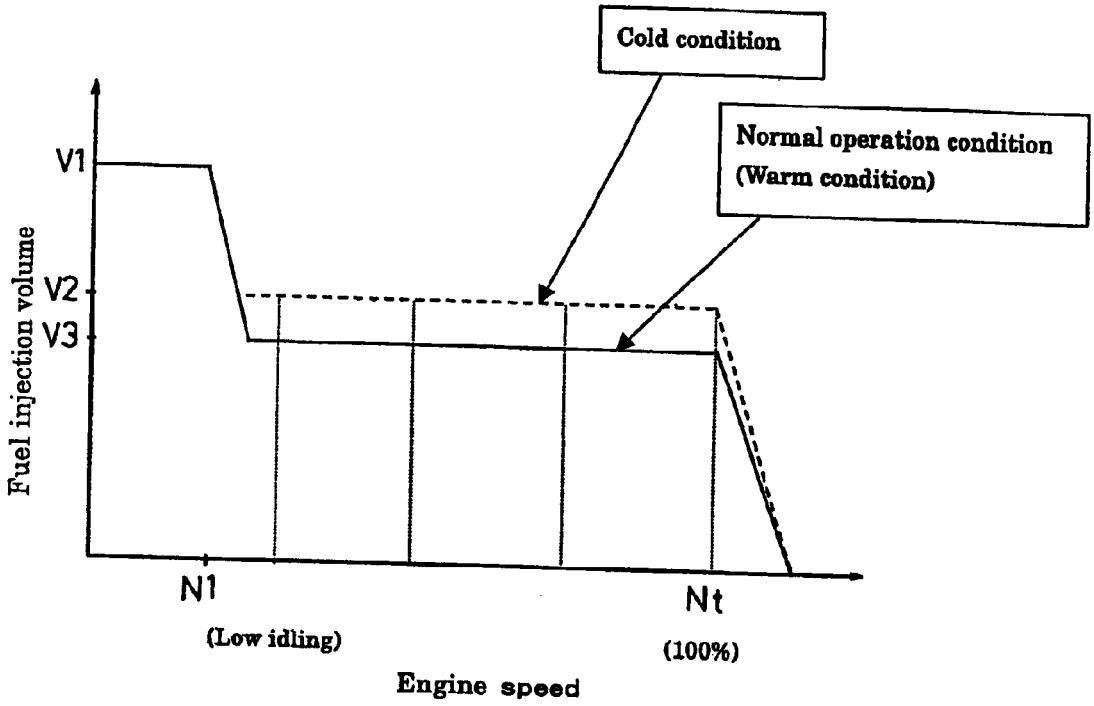
FIG. 8 is a graph showing the relation between the engine speed and the fuel injection rate when using the governor according to the present invention.

Therefore, as shown in FIG. 8, the decrease of fuel injection rate along with increasing the engine speed from the speed N1 is stopped when the engine is cold and a fuel injection rate V2 is reached, or when the engine is warm and a fuel injection rate V3 lower than the fuel injection rate V2 is reached. During the increase of engine speed after stopping the fuel decrease, if the engine is cold, the higher fuel injection rate V2 is kept so that high combustion efficiency is ensured and the engine speed can reach a desired value rapidly, and if the engine is warm, the lower fuel injection rate V3 is kept so as to reduce exhaust emission without generating black smoke, and to save fuel consumption. Due to the high engine temperature, the increased engine speed can reach the desired value with setting the lower fuel injection rate for a time not seriously longer than the time for increasing the engine speed to the desired value with the higher fuel injection under the cold engine condition.

In addition, the governor 11 is provided with a mechanism for forcibly turning the limiter 32 and the governor lever 31 in the fuel decreasing direction so as to decrease fuel injection rate when the engine speed exceeds a value Nt, which is 100% of the rated engine speed.

INDUSTRIAL APPLICABILITY

As the above, the fuel injection rate control device according to the present invention substantially uniforms a time required for increasing the rotational speed of a started engine to a set value so as to prevent deference of engine performance whether the engine is cold (e.g. at the time of starting the engine) or the engine is warm (e.g., when driving the engine after its warming up). This fuel injection rate control device is applicable to a diesel engine having a centrifugal governor for various uses, e.g., for driving a vehicle, or for driving a working machine such as a generator.

What is claimed is:

1. A fuel injection rate control device comprising:

a governor lever connected to a fuel injection rate control part of a fuel injection pump; and a limiter for controlling turning of the governor lever within a fixed range so as to control the fuel injection rate to an engine during start-up of the engine and during increase of rotational speed of the started engine, wherein a position of the limiter is changed corresponding to changes in temperature.

2. A fuel injection rate control device as set forth in claim 1, the limiter further comprising:

a control section for determining at least a limit position of the governor lever turning in fuel decreasing direction, wherein the limit position is moved in further fuel decreasing direction according to increase of temperature of the engine.

3. A fuel injection rate control device as set forth in claim 1, further comprising:

a stopper for determining a position of the limiter when output power of the engine is set to its maximum; and a heat sensitive expansion member provided in the stopper, wherein the position of the limiter is changed according to dilatation of the heat sensitive expansion member.

4. A fuel injection rate control device as set forth in claim 3, wherein wax is used as the heat sensitive expansion member.

5. A fuel injection rate control device as set forth in claim 3, the stopper further comprising:

slide members slid according to expansion of the heat sensitive expansion member; and a slide restriction member for restricting slide of the slide members; and a casing containing the heat sensitive expansion member, the slide members and the slide restriction member.

6. A fuel injection rate control device as set forth in claim 5, wherein springs are used as the slide restriction member.

7. A fuel injection rate control device as set forth in claim 3, wherein the stopper is attached to a side surface of the engine.

8. A fuel injection rate control device as set forth in claim 2, further comprising:

a stopper for determining a position of the limiter when output power of the engine is set to its maximum; and a heat sensitive expansion member provided in the stopper, wherein the position of the limiter is changed according to dilatation of the heat sensitive expansion member.

9. A fuel injection rate control device as set forth in claim 8, the stopper further comprising:

slide members slid according to expansion of the heat sensitive expansion member; and a slide restriction member for restricting slide of the slide members; and a casing containing the heat sensitive expansion member, the slide members and the slide restriction member.

10. A fuel injection rate control device as set forth in claim 8, wherein wax is used as the heat sensitive expansion member.

11. A fuel injection rate control device as set forth in claim 5, wherein wax is used as the heat sensitive expansion member.

12. A fuel injection rate control device as set forth in claim 6, wherein the stopper is attached to a side surface of the engine.

13. A fuel injection rate control device as set forth in claim 4, wherein the stopper is attached to a side surface of the engine.

14. A fuel injection rate control device as set forth in claim 5, wherein the stopper is attached to a side surface of the engine.

15. A fuel injection rate control device as set forth in claim 8, wherein the stopper is attached to a side surface of the engine.

16. A fuel injection rate control device as set forth in claim 9, wherein the stopper is attached to a side surface of the engine.

17. A fuel injection rate control device as set forth in claim 10, wherein the stopper is attached to a side surface of the engine.

18. A fuel injection rate control device as set forth in claim 13, wherein the stopper is attached to a side surface of the engine.

19. A fuel injection rate control device as set forth in claim 9, wherein springs are used as the slide restriction member.

* * * * *